US006154135A

United States Patent [19]

Kane et al.

[11] Patent Number: 6,154,135

[45] Date of Patent: Nov. 28, 2000

[54] APPARATUS FOR CAPTURING DATA AND DEACTIVATING ELECTRONIC ARTICLE SURVEILLANCE TAGS

[75] Inventors: Bradley P. Kane, Fort Lauderdale; Wayne H. Martin, Boca Raton; Mark D. Krom, Fort Lauderdale; Franklin H. Valade, Jr., Boynton Beach; Jon D. Buzzard, Margate, all of Fla.

[73] Assignee: Sensormatic Electronics Corporation, Boco Raton, Fla.

[21] Appl. No.: 08/721,122

[22] Filed: Sep. 26, 1996

[51] Int. Cl.[7] ..... G08B 13/14

[52] U.S. Cl. ..... 340/572; 235/383; 335/284; 340/551

[58] Field of Search ..... 340/572, 551; 343/867; 235/38; 186/61, 66; 335/284

[56] References Cited

U.S. PATENT DOCUMENTS

| | | | |
|---|---|---|---|
| 4,084,742 | 4/1978 | Silverman | 235/383 |
| 5,059,951 | 10/1991 | Kaltner | 340/572 |
| 5,126,720 | 6/1992 | Zhou et al. | 340/572 |
| 5,170,045 | 12/1992 | Bengtsson | 235/462 |
| 5,187,354 | 2/1993 | Bengtsson | 335/284 |
| 5,410,296 | 4/1995 | Montbriand et al. | 340/572 |
| 5,477,219 | 12/1995 | Zarembo et al. | 340/572 |
| 5,500,640 | 3/1996 | Zhou et al. | 340/572 |

FOREIGN PATENT DOCUMENTS

| | | | |
|---|---|---|---|
| 0355355A2 | 2/1990 | European Pat. Off. | G07G 1/00 |
| 0703552A1 | 3/1996 | European Pat. Off. | G08B 13/24 |

*Primary Examiner*—Daniel J. Wu
*Assistant Examiner*—John Tweel, Jr.
*Attorney, Agent, or Firm*—Paul T. Kashimba

[57] ABSTRACT

An apparatus for capturing data from indicia associated with an article and for deactivating an electronic article surveillance tag associated with the article comprising a housing defining a volume in which a bag can be placed for packaging the article, a scanner positioned adjacent the upper portion of the volume to capture data from the indicia associated with the article as the article is placed into the bag; and deactivation means positioned below the scanner to deactivate the electronic article surveillance tag when the article is in the bag.

28 Claims, 3 Drawing Sheets

APPARATUS FOR CAPTURING DATA AND DEACTIVATING ELECTRONIC ARTICLE SURVEILLANCE TAGS

FIELD OF THE INVENTION

This invention relates to electronic point-of-sale checkout and, more particularly, to point-of-sale data capturing and deactivation of electronic article surveillance tags.

BACKGROUND OF THE INVENTION

To facilitate retail checkout and to maintain inventory control, bar code symbols or other visible indicia have been applied to the surface of articles to provide data that can be read by a scanner. The data may be used to identify the article, its price, and other characteristics related to checkout and inventory control. Typically, a scanner includes a light source such as a laser or semiconductor device that generates a light beam. The light beam is optically modified usually by a lens to form a beam spot of a size suitable for use with the visual indicia to be read. Preferably the beam spot is approximately the same size as the minimum width between regions of different light reflectivity of the visual indicia, such as the bars and spaces of a bar code symbol.

The light beam is directed by optical components along a light path towards the article that includes a bar code symbol on its surface. A scanning component is also disposed in the light path. The scanning component may either sweep the beam spot across the symbol and trace a scan line across and past the symbol or scan the field of view of the scanner or both. The scanner also includes a photodetector that has a field of view which extends across and slightly past the symbol. The photodetector detects the light of varying intensities and generates electrical signals representative of the sequences of bars and spaces in the symbol. These electrical signals are then decoded into data, such as information about the article and its price. A clerk uses either a hand held scanner to read the bar code symbols on the articles one at a time or passes the articles over a counter top scanner one at a time. The clerk then places the articles into a shopping bag or other suitable bulk container.

Electronic article surveillance (EAS) systems have employed either reusable EAS tags or disposable EAS tags to monitor articles to prevent shoplifting and unauthorized removal of articles from store. The reusable EAS tags are normally removed from the articles before the customer exits the store. The disposable tags are generally attached to the packaging by adhesive or are disposed inside the packaging. These tags remain with the articles and must be deactivated before they are removed from the store by the customer. Deactivation devices use coils which are energized to generate a magnetic field of sufficient magnitude to render the EAS tag inactive. The deactivated tags are no longer responsive to the incident energy of the EAS system so that an alarm is not triggered.

In one type of deactivation system the checkout clerk passes the articles one at a time over a deactivation device to deactivate the tags and then places the articles into a shopping bag or other bulk container. This system employs one coil disposed horizontally within a housing. The clerk moves the tagged articles across the horizontal top surface of the housing such that the tag is disposed generally coplanar with the coil.

Another deactivation system utilizes a housing having a cavity with three sets of two coils each disposed around the cavity in respective x, y, and z axis planes, such that there is a coil located in a plane parallel to each side of the cavity and two coils disposed around the cavity with one being near the top and the other being near the bottom of the cavity. The checkout clerk places a bag or bulk container into the cavity and then places the tagged articles into the bag. After all of the articles have been placed into the bag or when the bag is full, the clerk energizes the coils to deactivate all of the EAS tags in the bag. The clerk then lifts the bag out of the cavity. This system provides deactivation of multiple tags at one time and does not require specific orientation of the tags.

Many retail establishments having high volumes find it desirable to expedite and facilitate the checkout process including the scanning of the bar code data and the deactivation of the EAS tags.

SUMMARY OF THE INVENTION

In accordance with the present invention there is provided an apparatus for capturing data from indicia associated with an article and for deactivating an electronic surveillance tag associated with the article. The apparatus comprises a housing, a scanner, and deactivation means. The housing defines a volume in which a bag can be placed for packaging of the article. The scanner is positioned adjacent to the upper portion of the volume so that data is captured from the indicia as the article is placed into the bag. The deactivation means is positioned below the scanner to deactivate the electronic surveillance tag associated with the article when the article is placed into the bag. In a preferred embodiment the scanner comprises a plurality of scanners positioned adjacent the upper portion of the volume so that a person placing an article into the bag is not restricted to a single path to capture the data from the indicia as the article is placed into the bag, and the deactivation means comprises a plurality of coils surrounding at least a portion of the volume.

In addition, the present invention provides an apparatus for capturing data from indicia associated with an article. The apparatus comprises a housing defining a volume in which a bag can be placed for packing of an article and a scanner positioned adjacent to the upper portion of the volume so that data is captured from the indicia as the article is placed into the bag. In a preferred embodiment the scanner comprises a plurality of scanners positioned adjacent the upper portion of the volume so that a person placing an article into the bag is not restricted to a single path to capture data from the indicia as the article is placed into the bag. As used herein, the indicia can be, for example, a bar code on a label applied to the article or a bar code printed on the article itself, and the bag can be a shopping bag or other suitable bulk container. The housing is preferably a solid walled structure, but can take other embodiments such as a wire structure.

Accordingly, the present invention provides an improved point-of-sale system to increase the overall throughput of the customer/retailer transaction which is advantageous to the retailer, the checkout clerk, and the customer. In a preferred embodiment the system allows the checkout clerk to scan the bar code with minimal concern as to the orientation of the bar code symbol and to deactivate the EAS tags without concern as to the orientation of the EAS tags. Bagging and scanning of the articles take place in one single movement, and all of the EAS tags associated with the articles are deactivated at one time when the clerk has finished packing the articles into the bag.

Other objectives, advantages, and applications of the present invention will be made apparent by the following detailed description of the preferred embodiment of the invention.

DETAILED DESCRIPTION OF PREFERRED EMBODIMENTS

Figure 1:
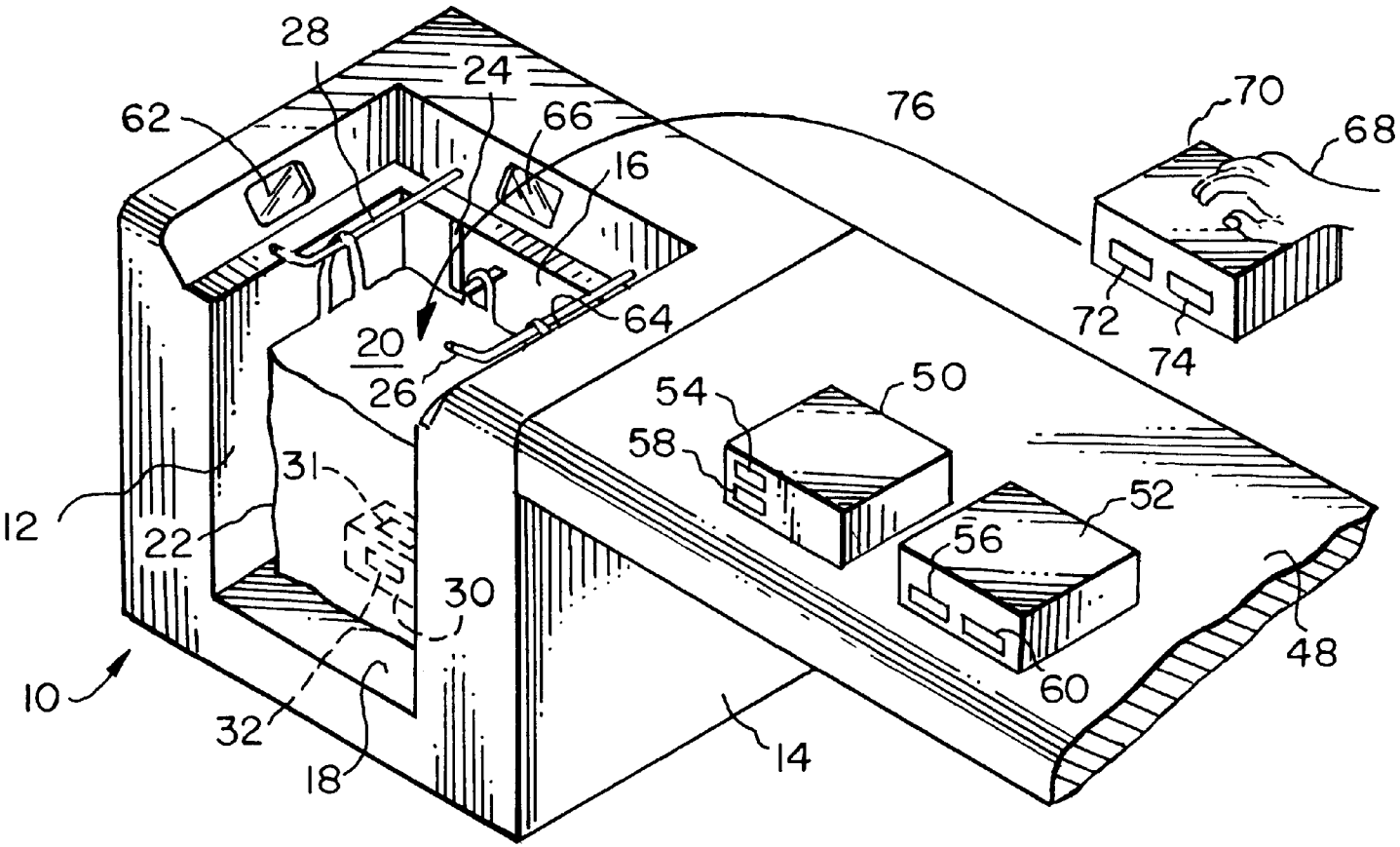
FIG. 1 is a perspective view of a bagging station having a scanning and deactivation system according to one embodiment of the present invention.

Referring to FIG. 1, a bagging station 10 incorporating the improved checkout system according to one embodiment of the present invention is shown. Bagging station 10 has three sidewalls 12, 14, and 16 and a bottom 18 that define a volume 20 in which a shopping bag 22 or other bulk container can be placed. A quantity of plastic shopping bags can be placed on bulk holder 24 with their handles on bag racks 26 and 28 and then pulled out for use one at a time. Bulk holder 24 and bag racks 26 and 28 are mounted on sidewall 16. Shopping bag 22 is in the pulled out position being disposed over bulk holder 24 and bag racks 26 and 28.

Bagging station 10 can be located next to a checkout counter 48 on which articles such as articles 50 and 52 are placed to be checked out. Articles 50 and 52 have bar code labels 54 and 56 attached which contain information about articles 50 and 52 that can be used for pricing and inventory control. Articles 50 and 52 also have associated EAS tags 58 and 60 for use with an EAS system as is known in the art. Preferably EAS tags 58 and 60 are magnetoacoustic EAS tags sold by the assignee of this application under the brand name "ULTRA•MAX®", such EAS tags are used widely for theft deterrence. Article 30 with its associated bar code label 31 and EAS label 32 is shown positioned in shopping bag 22 located in volume 20.

Bar code scanners 62, 64 (not visible in FIG. 1 because of the perspective drawing), and 66 are positioned adjacent the upper portions of sidewalls 12, 14, and 16 respectively. One type of bar code scanner that is suitable for use is the LS9100 scanner available from Symbol Technologies. As the articles being purchased by the customer, such as article 70 having associated bar code label 72 and EAS tag 74, are picked up by the clerk (indicated by hand 68) and placed into shopping bag 22, the information on bar code label 72 is captured by at least one of bar code scanners 62, 64, and 66. Bar code scanners 62, 64, and 66 can be connected to a cash register and central computer system as is known in the art. The positioning of scanners 62, 64, and 66 allows a single motion (indicated by arrow 76) to be used to place an article into shopping bag 22 and to scan the data on the bar code label associated with the article. It should be understood that other bar code scanner configurations can be used.

Figure 2:
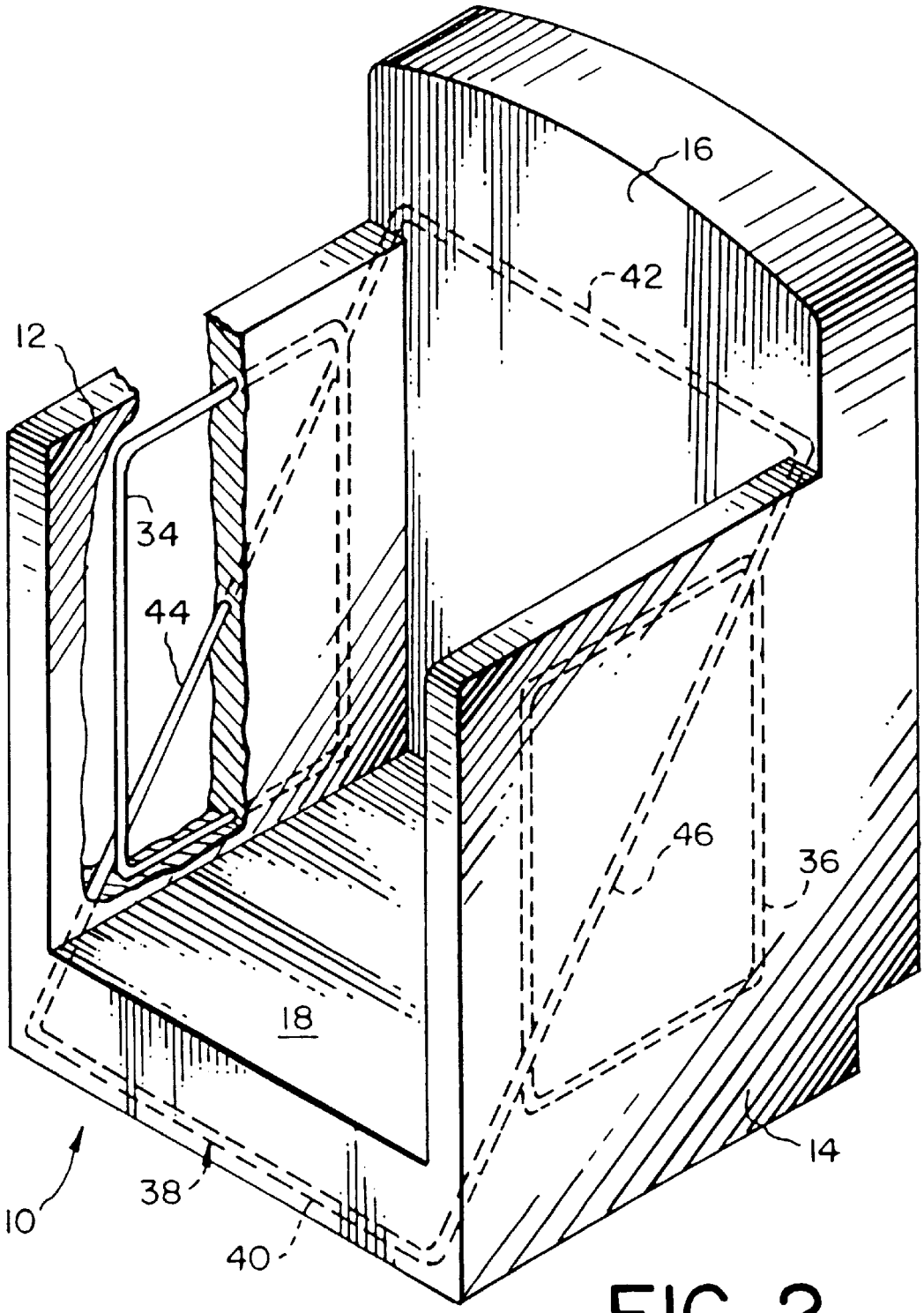
FIG. 2 is a perspective partially cut away view showing one embodiment of the deactivation coils in the bagging station of FIG. 1.
Figure 3:
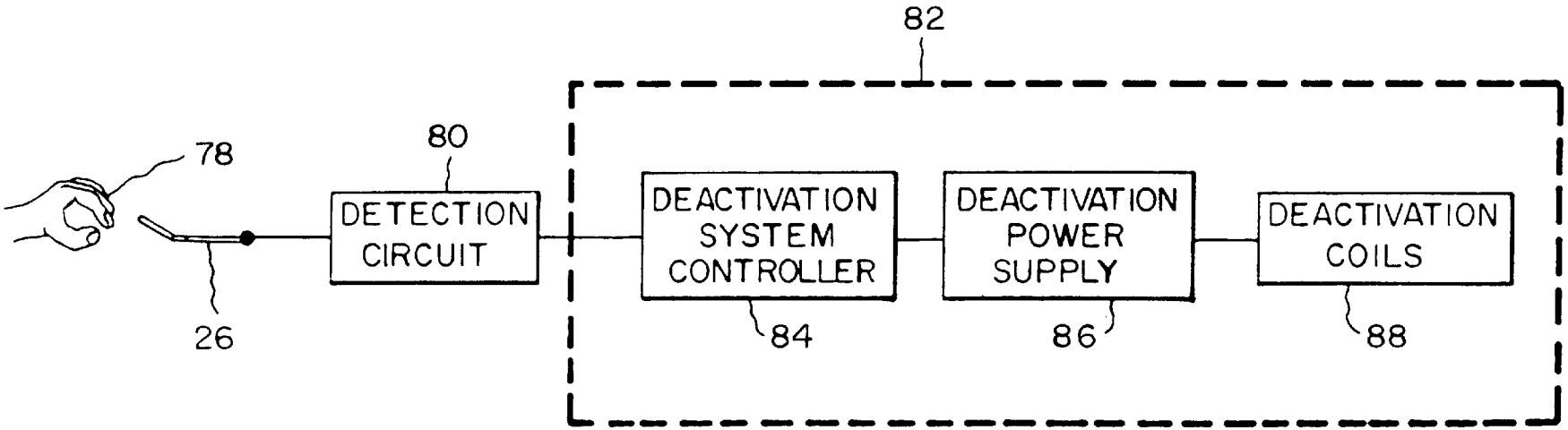
FIG. 3 is a schematic block diagram of one embodiment of an automatic actuation system for the deactivation coils of FIG. 2.

FIG. 2 shows one embodiment of a deactivation coil arrangement for use with bagging station 10. Deactivation coil 34 is located inside sidewall 12, and deactivation coil 36 is located inside sidewall 14. Sidewalls 12 and 14 are parallel so that deactivation coils 34 and 36 are located in parallel planes. Deactivation coil 38 has four coil sections 40, 42, 44, and 46. Coil section 40 is located in bottom 18 near the front portion thereof, and coil section 42 is located in sidewall 16 near the top portion thereof Coil sections 44 and 46 are located in sidewalls 12 and 14 respectively along the approximate respective diagonals of deactivation coils 34 and 36. A power supply which is shown in FIG. 3 is connected to deactivation coils 34, 36, and 38 to provide them with electrical energy to create the magnetic fields to deactivate all EAS tags in shopping bag 22. The power supply can energize deactivation coils 34, 36, and 38 by a switch operated by hand or foot. Preferably, the deactivation coils are energized automatically as discussed below with reference to FIG. 3. In addition, it should be understood that other deactivation coil arrangements can be utilized with the present invention. For example, a plurality of deactivation coils such as those used in the deactivation system marketed by the assignee of the present invention under the brand name Rapid Pad™ could be positioned in the sidewalls and bottom of bagging station 10. In addition, it should be understood that bagging station 10 can have alternative embodiments such as four sidewalls, sidewalls that join at angles different than 90 degrees, two sidewalls, and so forth.

Referring to FIG. 3, one embodiment of an automatic deactivation system is disclosed. Bagging rack 26, which is a member such as a metal tube or other suitable structure, is connected to detection circuit 80 which detects the amount of capacitance in a circuit connected to bagging rack 26. Bagging rack 26 is electrically insulated from ground potential, e.g., by being mechanically mounted as shown in FIG. 1 on sidewall 16 which is made of a nonconducting material. Detection circuit 80 detects when the checkout clerk is in the process of removing a bag from member 26, which includes the movement of the person's hand toward the bag and member as well as actually removing the bag from the member by detecting the change in capacitance caused by the clerk's hand approaching bagging rack 26. Detection circuit 80 detects when a hand (shown by numeral 78) of the checkout clerk is a predetermined distance from bagging rack 26 or in actual contact with bagging rack 26.

Detection circuit 80 is connected to deactivation system 82 which includes deactivation system controller 84, deactivation power supply 86, and deactivation coils 88 (which can be deactivation coils 34, 36, and 38 as shown in FIG. 2). When detection circuit 80 detects that hand 78 is within a predetermined distance of bagging rack 26, a signal is provided to deactivation system controller 84. In response to this signal deactivation system controller 84 provides the necessary control signals to deactivation power supply 86 so that power supply 86 energizes deactivation coils 88 to create a field of sufficient strength to deactivate an EAS tag that is in the effective area of deactivation coils 88.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. An apparatus for capturing data from indicia associated with articles and for deactivating electronic article surveillance tags associated with said articles, said apparatus comprising: a housing defining a volume in which a bag can be placed for packaging said articles; a scanner positioned adjacent the upper portion of said volume to capture data from said indicia associated with said articles as said articles are placed into said bag; and deactivation means positioned below said scanner to deactivate all of said electronic article surveillance tags simultaneously when said articles are in said bag.

2. An apparatus as recited in claim 1, wherein said deactivation means comprises a plurality of deactivation coils surrounding at least a portion of said volume.

3. An apparatus as recited in claim 2, wherein said housing has three sidewalls and a bottom and said plurality of deactivation coils are positioned in said sidewalls and said bottom.

4. An apparatus as recited in claim 3, wherein said scanner comprises a plurality of scanners positioned adjacent the upper portion of said volume so that a person placing said article into said bag is not restricted to a single path to have data captured from said indicia as said article is placed into said bag.

5. An apparatus as recited in claim 4, wherein said plurality of scanners are positioned such that there is a scanner on each of said sidewalls.

6. An apparatus as recited in claim 4, wherein the fourth side of said housing is open to facilitate removal of said bag from said volume.

7. An apparatus as recited in claim 1, wherein said scanner comprises a plurality of scanners positioned adjacent the upper portion of said volume so that a person placing said article into said bag is not restricted to a single path to have said data captured from said indicia as said article is placed into said bag.

8. An apparatus as recited in claim 7, wherein said housing has three sidewalls and said plurality of scanners are positioned such that there is a scanner on each of said sidewalls.

9. An apparatus as recited in claim 8, wherein the fourth side of said housing is open to facilitate removal of said bag from said volume.

10. An apparatus for capturing data from indicia associated with an article and for deactivating an electronic article surveillance tag associated with said article, said apparatus comprising: a counter; a housing positioned below said counter and defining a volume in which a bag can be placed for packaging said article; a scanner positioned below said counter and adjacent the upper portion of said volume so that said data is captured from said indicia as said article is placed into said bag; and deactivation means positioned below said scanner to deactivate all electronic article surveillance tags in said bag simultaneously.

11. An apparatus as recited in claim 10, wherein said scanner comprises a plurality of scanners positioned below said counter and adjacent the upper portion of said volume so that a person placing said article into said bag is not restricted to a single path to have said data captured from said indicia as said article is placed into said bag.

12. An apparatus as recited in claim 11, wherein said housing has three sidewalls and said plurality of scanners are positioned such that there is a scanner on each of said sidewalls.

13. An apparatus as recited in claim 12, wherein the fourth side of said housing is open to facilitate removal of said bag from said volume.

14. An apparatus as recited in claim 13, wherein said indicia is a bar code.

15. An apparatus for capturing data from indicia associated with an article and for deactivating an electronic article surveillance tag associated with said article, said apparatus comprising: a housing defining a volume in which a bag can be placed for packaging said article; a scanner positioned adjacent the upper portion of said volume so that the bagging of said article and the scanning of said indicia associated with said article to capture data from said indicia occur in a single arm movement by a person placing said article into said bag; and deactivation means positioned below said scanner to deactivate all electronic article surveillance tags in said bag simultaneously.

16. An apparatus as recited in claim 15, wherein said deactivation means comprises a plurality of deactivation coils surrounding at least a portion of said volume.

17. An apparatus as recited in claim 16, wherein said housing has three sidewalls and a bottom and said plurality of deactivation coils are positioned in said sidewalls and said bottom.

18. An apparatus as recited in claim 17, wherein said scanner comprises a plurality of scanners positioned adjacent the upper portion of said volume so that a person placing said article into said bag is not restricted to a single path to have data captured from said indicia as said article is placed into said bag.

19. An apparatus as recited in claim 18, wherein said plurality of scanners are positioned such that there is a scanner on each of said sidewalls.

20. An apparatus as recited in claim 18, wherein the fourth side of said housing is open to facilitate removal of said bag from said volume.

21. An apparatus as recited in claim 15, wherein said scanner comprises a plurality of scanners positioned adjacent the upper portion of said volume so that a person placing said article into said bag is not restricted to a single path to have said data captured from said indicia as said article is placed into said bag.

22. An apparatus as recited in claim 21, wherein said housing has three sidewalls and said plurality of scanners are positioned such that there is a scanner on each of said sidewalls.

23. An apparatus as recited in claim 22, wherein the fourth side of said housing is open to facilitate removal of said bag from said volume.

24. An apparatus as recited in claim 10, wherein said deactivation means comprises a plurality of deactivation coils surrounding at least a portion of said volume.

25. An apparatus as recited in claim 24, wherein said housing has three sidewalls and a bottom and said plurality of deactivation coils are positioned in said sidewalls and said bottom.

26. An apparatus as recited in claim 25, wherein said scanner comprises a plurality of scanners positioned adjacent the upper portion of said volume so that a person placing said article into said bag is not restricted to a single path to have data captured from said indicia as said article is placed into said bag.

27. An apparatus as recited in claim 26, wherein said plurality of scanners are positioned such that there is a scanner on each of said sidewalls.

28. An apparatus as recited in claim 26, wherein the fourth side of said housing is open to facilitate removal of said bag from said volume.

* * * * *